US005445377A

United States Patent [19]

Steinbach

[11] Patent Number: 5,445,377

[45] Date of Patent: Aug. 29, 1995

[54] CARD SHUFFLER APPARATUS

[76] Inventor: James R. Steinbach, 9776 Orangewood Dr., Denver, Colo. 80221

[21] Appl. No.: 215,933

[22] Filed: Mar. 22, 1994

[51] Int. Cl.[6] ..... A63F 1/12

[52] U.S. Cl. ..... 273/149 R

[58] Field of Search ..... 273/149 R

[56] References Cited

U.S. PATENT DOCUMENTS 1,846,063 2/1932 Matthaey ..... 273/149 R
2,661,215 12/1953 Stevens ..... 273/149 R

OTHER PUBLICATIONS

Advertising Circular, Shuffle Master, Inc., Double Deck Shufflers.
Advertising Circular, Shuffle Master, Inc., Single Deck Shufflers.
Advertising Circular, Shuffle Master, Inc., Poker Shuffler.

*Primary Examiner*—Benjamin H. Layno
*Attorney, Agent, or Firm*—Carl Schaukowitch

[57] ABSTRACT

A card shuffler apparatus is adapted to be placed on a horizontal support surface and is operative to combine a plurality of stacks of unshuffled cards into a single stack of shuffled cards. Each stack of unshuffled cards has at least two cards. The card shuffler apparatus includes a card feeder compartment, a card receiver compartment, a deflector structure and a card ejector mechanism. The card feeder compartment is sized to accommodate the plurality of stacks of unshuffled cards in a juxtaposed relationship. The card receiver compartment is sized to accommodate the single stack of shuffled cards and is disposed below the card feeder compartment. The deflector structure defines a chute which is disposed between and in communication with the card feeder compartment and the card receiver compartment. The card ejector mechanism is associated with the card feeder compartment and is operative to eject at least a single card in each stack of unshuffled cards disposed in the card feeder compartment into the chute. Ejected ones of the cards deflect into and descend in the card receiver compartment to accumulate therein until all cards are ejected from the card feeder compartment thereby forming the single stack of shuffled cards. Also, a method for combining a plurality of stacks of unshuffled cards into a single stack of shuffled cards is described.

22 Claims, 11 Drawing Sheets

CARD SHUFFLER APPARATUS

FIELD OF INVENTION

The present invention relates to a card shuffler apparatus which is operative to combine a plurality of stacks of unshuffled cards into a single stack of shuffled cards. More specifically, the present invention is directed to a card shuffler apparatus which combines two stacks of unshuffled playing cards into a single stack of shuffled playing cards. The present invention is particularly suited to shuffle multiple decks of playing cards used to play blackjack and other playing cards games.

BACKGROUND OF THE INVENTION

Gaming is a popular adult pastime throughout the world. Gaming enterprises offer its gambling patrons numerous games of chance such as slot machines, poker machines, keno, dice and a variety of playing card games. One of the more popular playing card games is blackjack which is commonly referred to as "21". At a blackjack table, up to seven players have an opportunity to play cards against a card dealer. The object of blackjack is to obtain a numerical card value of twenty-one (21) or less, that is greater than the card dealer's numerical card value. Any blackjack player including the dealer whose numerical card value exceeds 21 automatically loses. When using a single deck of fifty-two (52) playing cards with a full table of blackjack players, the dealer is required to shuffle the deck after every one or two games of blackjack. Shuffling is disruptive to the game of blackjack and generates an element of boredom for the blackjack players because they must wait until the dealer completes shuffling of the cards before the next game of blackjack can begin. In an attempt to eliminate this aspect of boredom during blackjack, six (6) decks of playing cards to be dealt from a dealer shoe have been combined in order to increase the number of games of blackjack without shuffling. Although a six (6) deck blackjack game does reduce the number of shuffles for the dealer compared to a single deck, it now takes a dealer approximately three to five minutes to shuffle six (6) decks of playing cards after the playing cards are depleted from the shoe. Thus, even though the number of shuffles have dramatically decreased throughout the game of blackjack employing a six-deck (6) dealer shoe, the period of time required to shuffle six (6) decks of playing cards has substantially increased. This increased period of time to shuffle is disruptive and stints the blackjack game, thus creating a longer period of boredom for the blackjack players.

Additionally, a few unlucky blackjack players sometimes attribute their losses to the dealer because it is falsely believed that the dealer is intentionally manipulating cards in the deck to the players' disadvantage as it is being shuffled. Although untrue, the gaming establishments are aware of this fanciful notion and consider viable alternatives to dispel this myth in order to retain integrity in the game of blackjack and bolster the interest of all blackjack players to continue playing the game. In order to resolve these problems, i.e. player boredom during shuffling and the notion of manually manipulating the deck during shuffling, an automatic card shuffler device has been developed.

A single deck of cards is placed into the automatic card shuffler device which rests on its own stand proximate to the dealer and the blackjack table. While the dealer deals cards to the blackjack players with a separate deck of playing cards, the deck of playing cards within the automatic card shuffler device is being shuffled. The mechanism housed within the automatic shuffler device which drives the shuffling operations is delicate and complex. A wiper element cuts the single deck of playing cards into approximately equal stacks of unshuffled playing cards in a juxtaposed relationship. With a slight force, the mechanism urges the two stacks of unshuffled cards together along abutting ends. A probe having a conical end portion rises between the two stacks of unshuffled cards upwardly through their abutting ends. After slightly bending each stack of unshuffled cards, the playing cards return into their original flat configuration in an overlapped manner. The playing cards are then pushed together to form a single shuffled deck of cards. This process is repeated several times over a four or five minute period to assure thorough shuffling of the single deck of playing cards. After the dealer deals the shuffled deck of cards to the players, the cards are gathered and stacked into an unshuffled deck which is then exchanged for the shuffled one in the automatic card shuffler device. The game of blackjack can then immediately resume without boring the blackjack players with shuffling while eliminating any notion that the blackjack dealer is manipulating the cards during shuffling.

Indeed the automatic card shuffler device has eliminated the boredom for the players during shuffling and the notion of manually manipulating the playing cards. However, the automatic card shuffler device has adherent problems. First, the automatic card shuffler device is a sophisticated and delicate device which requires regular maintenance to avoid malfunction. Second, the automatic card shuffler device can only shuffle a single deck of playing cards at a time. Third, due to the complexity of the card shuffling operation, the automatic card shuffler device is slow to shuffle a single deck of playing cards. Fourth, the single deck card shuffler device is so large that another table is typically required for its use.

Therefore, a need exists in the gaming industry to provide a new and improved automatic card shuffler apparatus. One need includes a card shuffler apparatus which is technically simple and sufficiently compact for placement upon a card table. It would be an advantage to have a card shuffler apparatus which can shuffle either a single deck of playing cards or multiple decks of playing cards. It would be advantageous if the card shuffler apparatus could rapidly shuffle either a single deck or multiple decks of playing cards. The present invention addresses these needs and advantages.

SUMMARY OF INVENTION

It is an object of the present invention to provide a new and useful card shuffler apparatus which can combine at least two stacks of unshuffled cards into a single stack of shuffled cards.

It is a further object of the present invention to provide a card shuffler apparatus which is mechanically simple so that fabrication and maintenance are not problematic.

It is another object of the present invention to provide a card shuffler apparatus which is compact so that it might be placed upon a card table without interfering with the game of cards being played.

Yet another object of the present invention is to provide a card shuffler apparatus which can shuffle either a single deck of playing cards or multiple decks of playing cards.

Still a further object of the present invention is to provide a card shuffler apparatus which can rapidly shuffle either a single deck of playing cards or multiple decks of playing cards.

Yet another object of the present invention is to provide a card shuffler apparatus whereby card players can observe automatic shuffling of the playing cards as a form of entertainment to reduce player boredom and eliminate the notion of manipulating the playing cards.

According to the present invention, a playing card shuffler apparatus is described which is adapted to be placed on a horizontal support surface and is operative to combine two stacks of unshuffled playing cards into a single stack of shuffled playing cards. In its broadest form, the playing card shuffling device includes a card feeder compartment, a card receiver compartment, a deflector structure and a card feeder mechanism. The card feeder compartment is sized to accommodate the two stacks of unshuffled playing cards in a juxtaposed relationship. The card receiver compartment is sized to accommodate the single stack of shuffled playing cards and is disposed below the card feeder compartment. The deflector structure defines a chute disposed between and in communication with the card feeder compartment and the card receiver compartment. The card feeder mechanism is associated with the card feeder compartment and is operative to simultaneously eject at least a bottom card in each stack of unshuffled playing cards disposed in the card feeder compartment into the chute. Ejected ones of the playing cards deflect into and descend in the card receiver compartment. The ejected cards accumulate in the card receiver compartment until all playing cards are ejected from the card feeder compartment, thus forming the single stack of shuffled playing cards.

The feeder compartment is defined by a vertical fence which is operative to prevent remaining ones in the stacks of unshuffled playing cards disposed in the card feeder compartment from entering the chute when the card feeder mechanism ejects the bottom cards in each stack of unshuffled playing cards disposed in the card feeder compartment into the chute. The card feeder compartment is further defined by a pair of vertical feeder sidewalls and a vertical divider. The pair of feeder sidewalls are spaced apart from each other in a parallel relationship and are oriented perpendicularly relative to the fence. The vertical divider extends perpendicularly relative to the fence and operates to separate the two stacks of unshuffled playing cards from one another.

The card receiver compartment is defined by a pair of vertical receiver sidewalls spaced apart from one another and parallel to the pair of feeder sidewalls. A card retainer structure extends transversely to the pair of receiver sidewalls and operates to retain ejected playing cards within the card receiver compartment after the card feeder mechanism ejects the bottom ones in each stack of unshuffled playing cards disposed in the card feeder compartment into the chute. It is preferred that the retainer structure is a door which is operative to pivot between a closed state and an opened state. In the closed state, the door prevents access into the card receiver compartment and, in the opened state, the door allows access into the card receiver compartment.

The deflector structure is defined by a pair of deflector sidewalls and a deflector panel. The pair of deflector sidewalls converge from the card feeder compartment toward the card receiver compartment. It is preferred that each deflector sidewall converges from a respective one of the card feeder sidewalls towards a respective one of the card receiver sidewalls. The deflector panel extends between the deflector sidewalls and operates to deflect the playing cards ejected into the chute from the card feeder compartment downwardly into the card receiver compartment.

The card feeder mechanism includes a roller assembly having at least a first roller element with a first axis of rotation and a roller drive operative to impart rotational movement to the first roller element. The first roller element is adapted to extend across the card feeder compartment parallel to the fence and is disposed proximate thereto to define an opening between the fence and the first roller element. The opening is dimensioned to permit at least the bottom card in each stack of the unshuffled playing cards to pass therethrough when the card feeder mechanism ejects the at least bottom card in each stack of unshuffled playing cards disposed in the card feeder compartment into the chute. The roller element assembly includes a second roller element having a second axis of rotation. The second roller element is spaced apart from the first roller element and is adapted to extend across the card feeder compartment so that the axis of rotation of the first roller element and the axis of rotation of the second roller element define a roller plane. The roller plane is oriented relative to the horizontal support surface within a range of 1 degree and 10 degrees with the second axis of rotation being disposed above the first axis of rotation.

The first roller element and second roller element are mounted for rotation onto and between the feeder sidewalls and are operative to support the two stacks of unshuffled playing cards disposed in the card feeder compartment by contacting the bottom card in each stack of unshuffled playing cards. The roller assembly is operative so that the first roller element rotates more rapidly than the second roller element.

A second exemplary embodiment of the card shuffler apparatus of the present invention is adapted to shuffle stacks of any type of cards, such as cards commonly used in board games. The second exemplary embodiment of the card shuffler apparatus is operative to combine a plurality of stacks of unshuffled cards into a single stack of shuffled cards. Each stack of unshuffled cards has at least two cards. The card feeder compartment is sized to accommodate the plurality of stacks of unshuffled cards in a juxtaposed relationship. The card feeder compartment includes a plurality of vertical dividers, each extending perpendicularly relative to the fence and operative to separate the stacks of unshuffled cards disposed in the card feeder compartment from one another. The card feeder mechanism is associated with the card feeder compartment and is operative to eject at least a single card in each stack of unshuffled cards disposed in the card feeder compartment into the chute so that ejected ones of the cards deflect into and descend in the card receiver compartment to accumulate therein until all cards are ejected from the card feeder compartment to form the single stack of shuffled cards.

The exemplary embodiments of the card shuffler apparatus of the present invention employ a method for combining a plurality of stacks of unshuffled cards into a single stack of shuffled cards. A first step includes placing the plurality of stacks of unshuffled cards in the card feeder compartment. The next step includes ejecting at least a single one of unshuffled cards from each stack disposed in the card feeder compartment into a chute until all cards are ejected from the card feeder compartment. The next step includes deflecting the at least single ones of the cards ejected into the chute into a card receiver compartment which is adapted to receive the ejected cards from the chute to form the single stack of shuffled cards.

These and other objects of the present invention will become more readily appreciated and understood from a consideration of the following detailed description of the exemplary embodiments of the present invention when taken together with the accompanying drawings, in which:

BRIEF DESCRIPTION OF DRAWINGS

FIG. 3-*b* is a side view in cross-section of the card shuffler apparatus showing a stack of unshuffled cards disposed in the card feeder compartment;

FIG. 4-*b* is a side view in cross-section of the card shuffler apparatus showing the single stack of shuffled cards accumulated into the card receiver compartment;

FIG. 5-*b* is a side view in cross-section of the card shuffler apparatus showing a card ejected from the card feeder compartment into the chute being deflected downwardly by a deflector panel;

FIG. 6-*b* is a side view in cross-section of the card shuffler apparatus showing two cards being deflected downwardly into the card receiver compartment;

DETAILED DESCRIPTION OF THE EXEMPLARY EMBODIMENTS

A card shuffler apparatus of the present invention is operative to combine a plurality of stacks of unshuffled cards into a single stack of shuffled cards. The card shuffler apparatus is particularly suitable to combine two stacks of unshuffled playing cards into a single stack of shuffled playing cards. A specific application for the present invention is shuffling playing cards used to play the card game, blackjack. Typically, blackjack is played with either one deck of playing cards, two decks of playing cards or six decks of playing cards. The present invention can shuffle the playing cards necessary to play blackjack or any other playing card game regardless of the number of decks of playing cards being used. Additionally, the present invention can be adapted to combine a plurality of stacks of other types of cards into a single stack of shuffled cards. For example, cards used in family board games or trivia games can be shuffled by the present invention.

Figure 1:
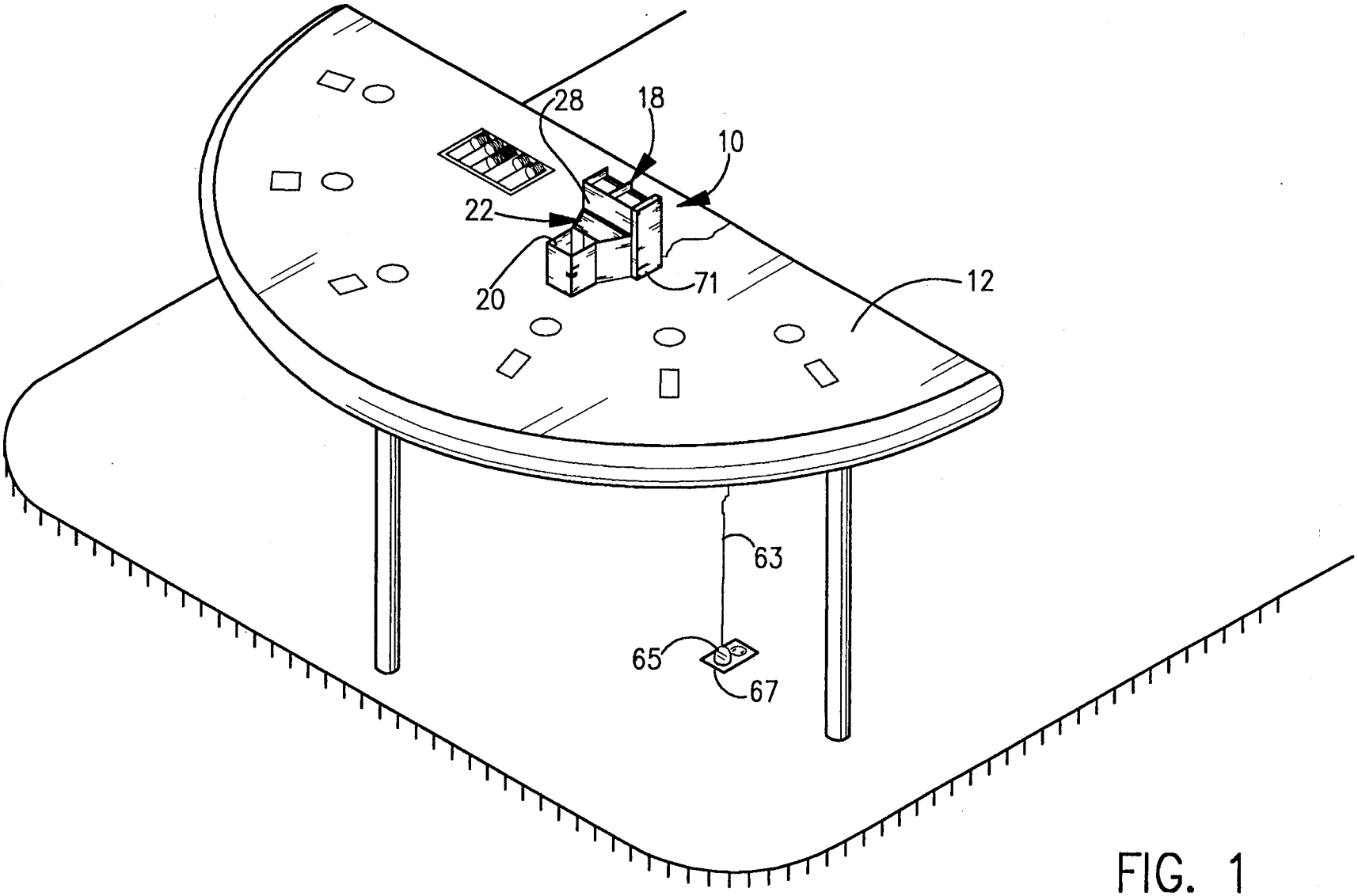
FIG. 1 is a perspective view showing a card shuffler device of the present invention placed upon a blackjack table.
Figure 2:
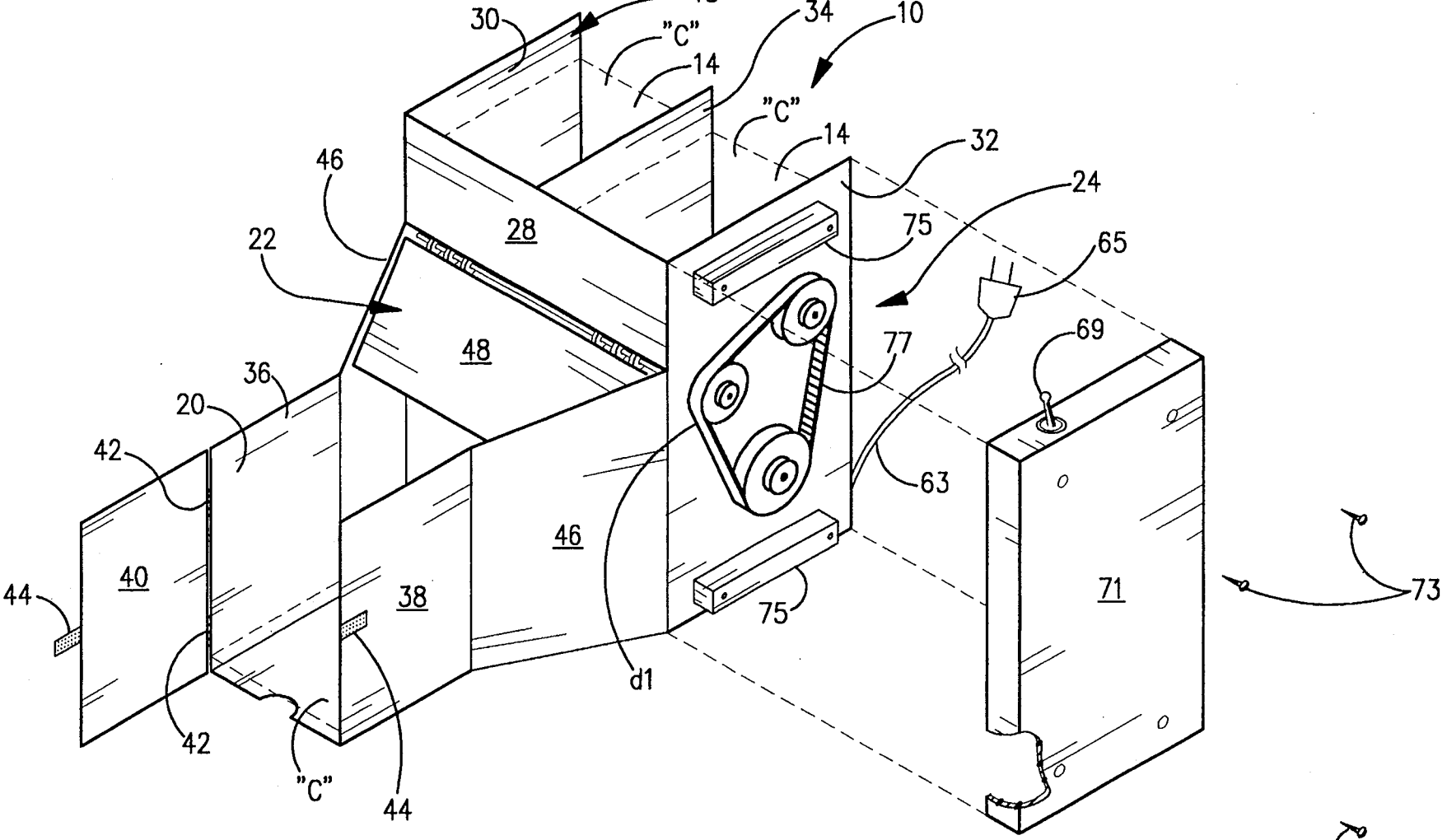
FIG. 2 is a partially exploded perspective view of the card shuffler apparatus of the present invention shown in FIG. 1.
Figure 3A:
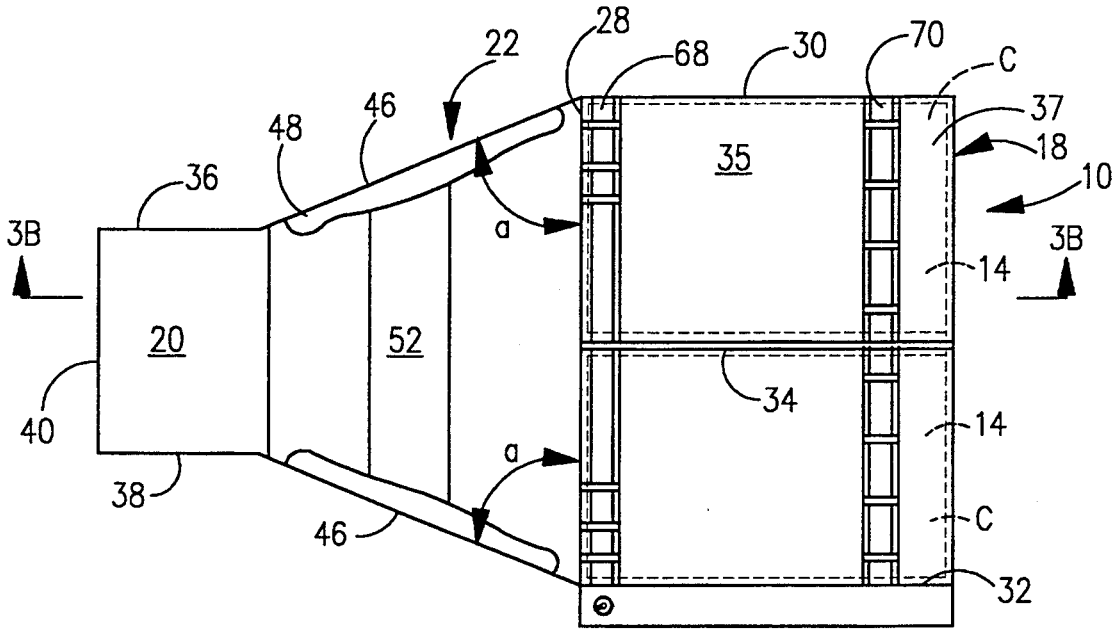
FIG. 3-*a* is a top view of the card shuffler apparatus showing two stacks of unshuffled cards disposed in a card feeder compartment.
Figure 3B:
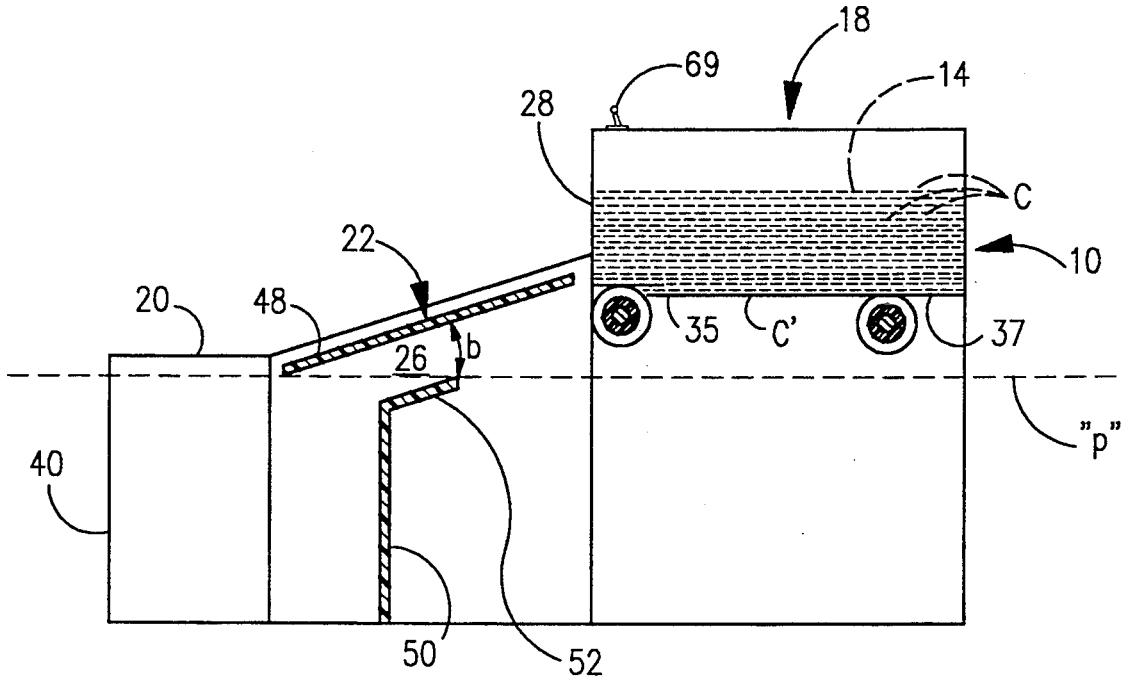
Figure 4A:
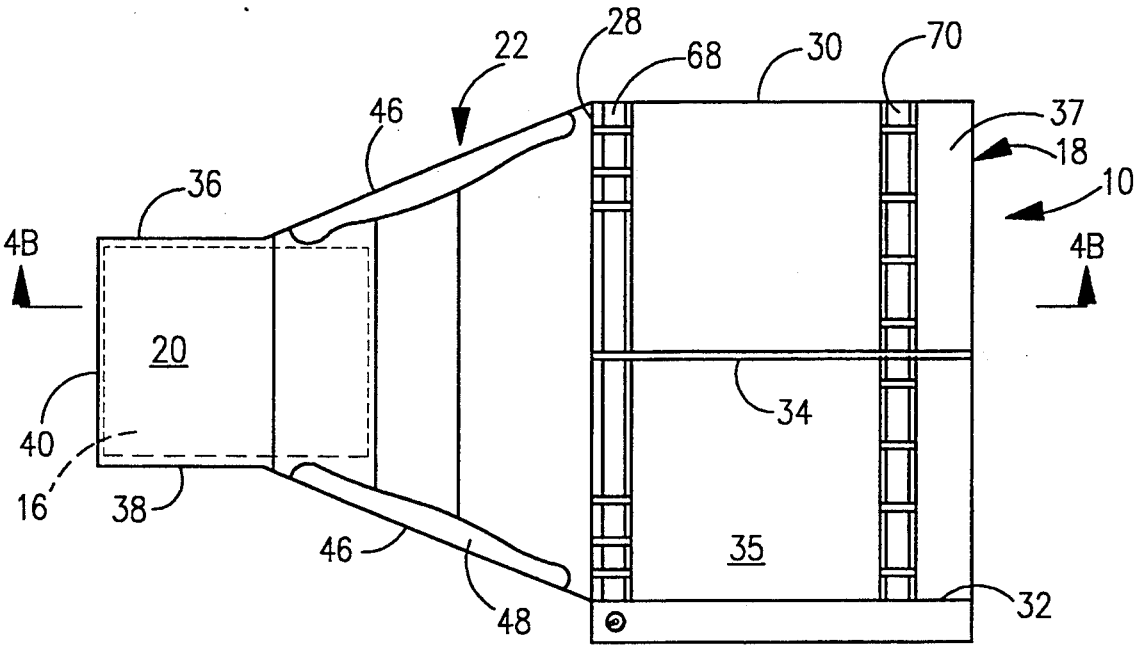
FIG. 4-*a* is a top view of the card shuffler apparatus showing a single stack of shuffled cards accumulated in a card receiver compartment.
Figure 4B:
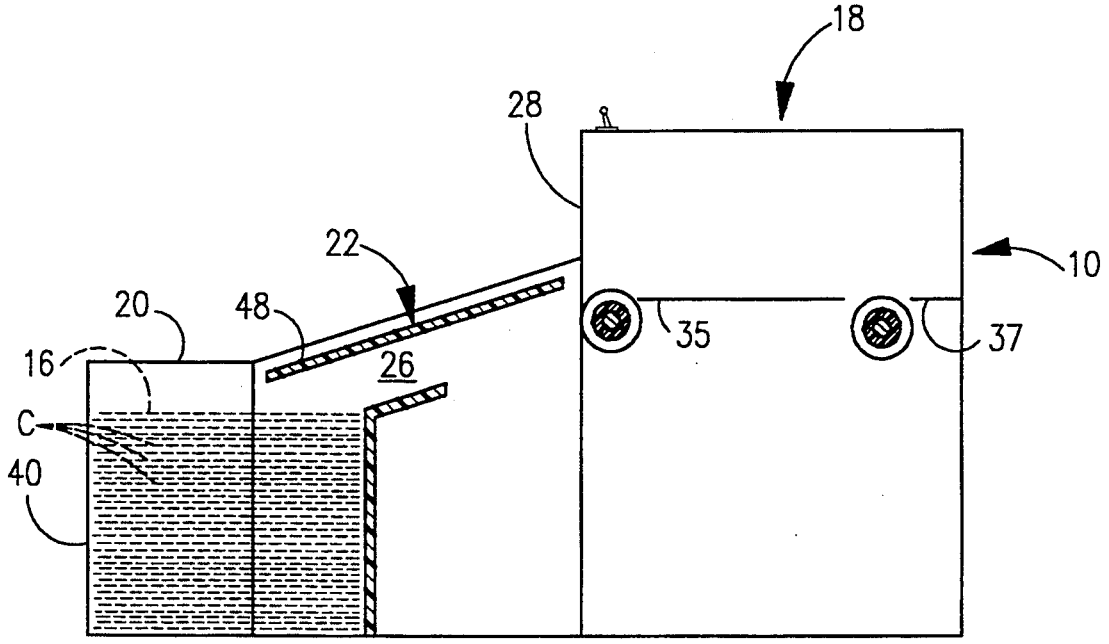
Figure 5A:
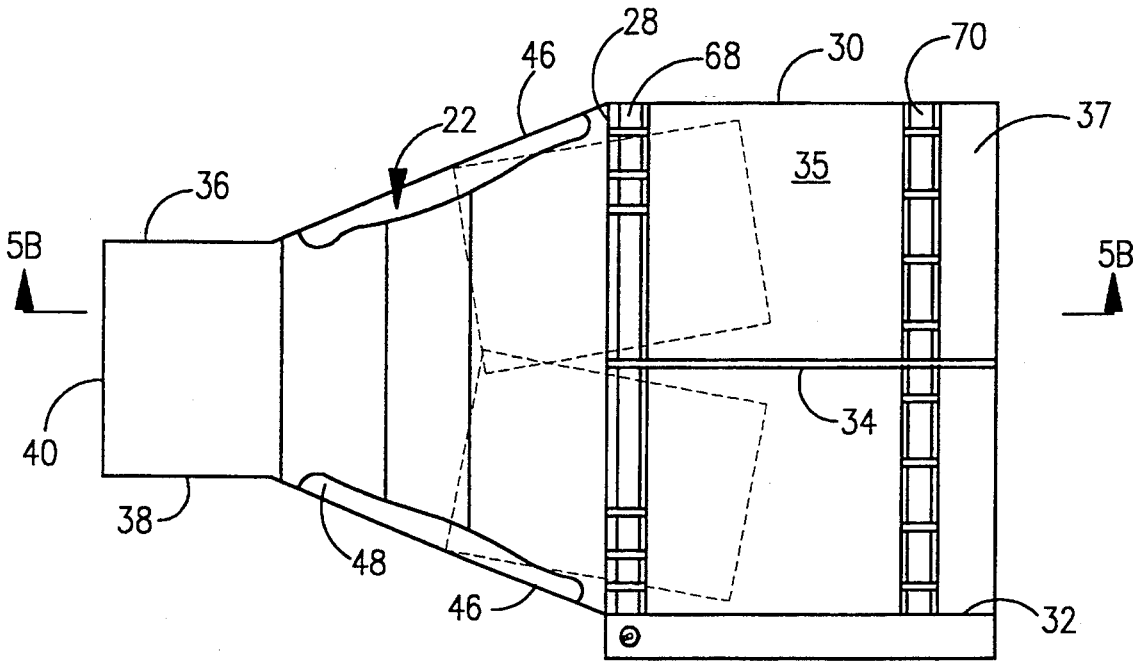
FIG. 5-*a* is a top view of the card shuffler apparatus showing two cards being ejected from the card feeder compartment into a chute wherein the cards are being deflected.
Figure 5B:
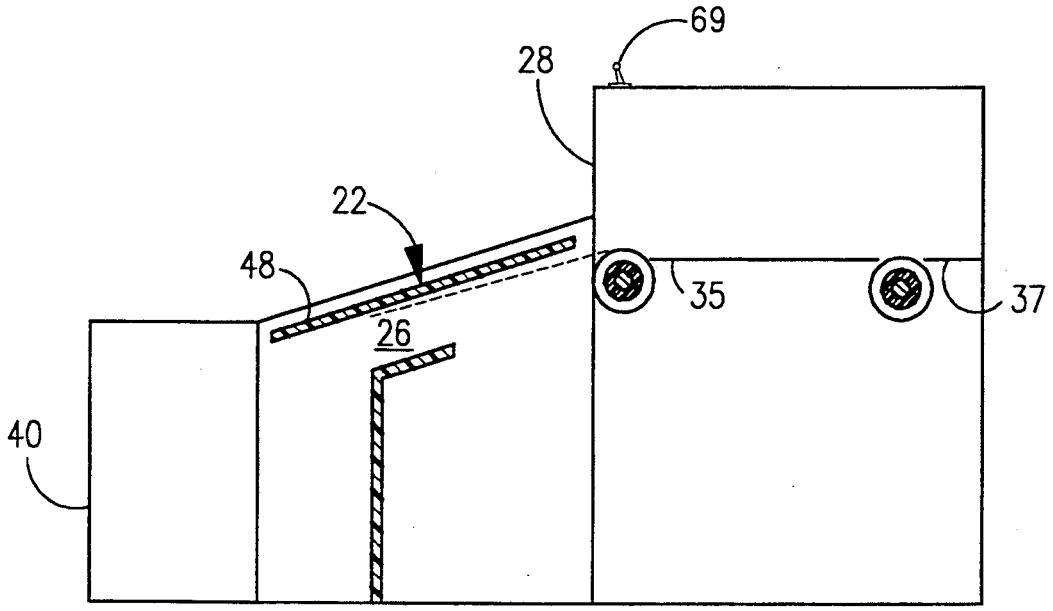
Figure 6A:
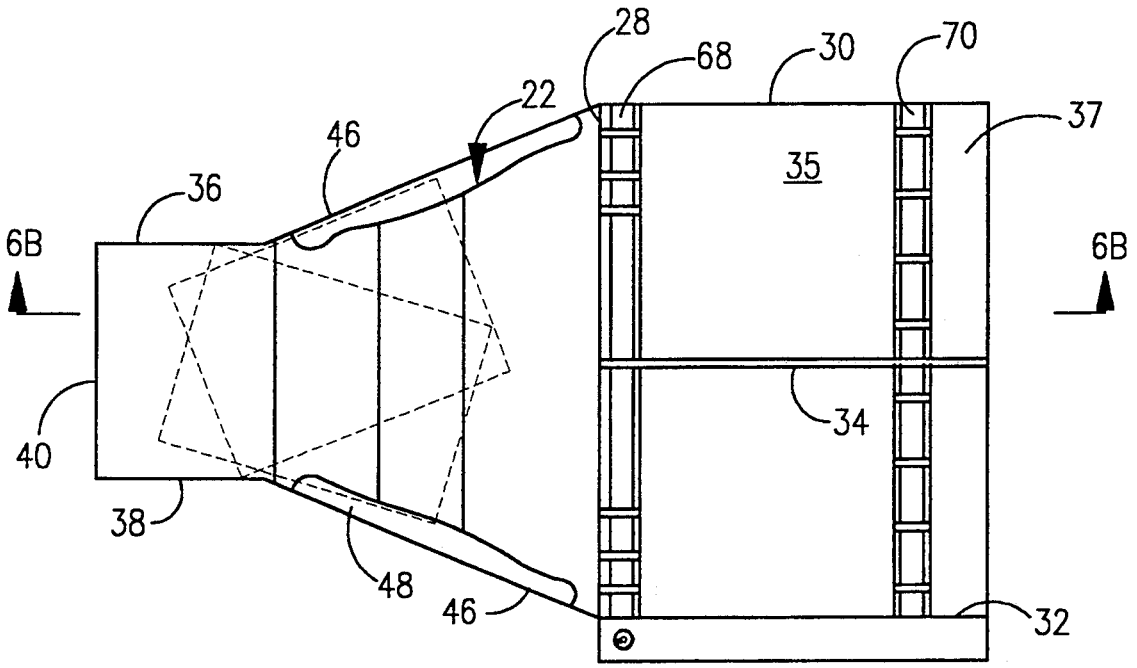
FIG. 6-*a* is a top view of the card shuffler apparatus showing two cards deflecting into the card receiver compartment.
Figure 6B:
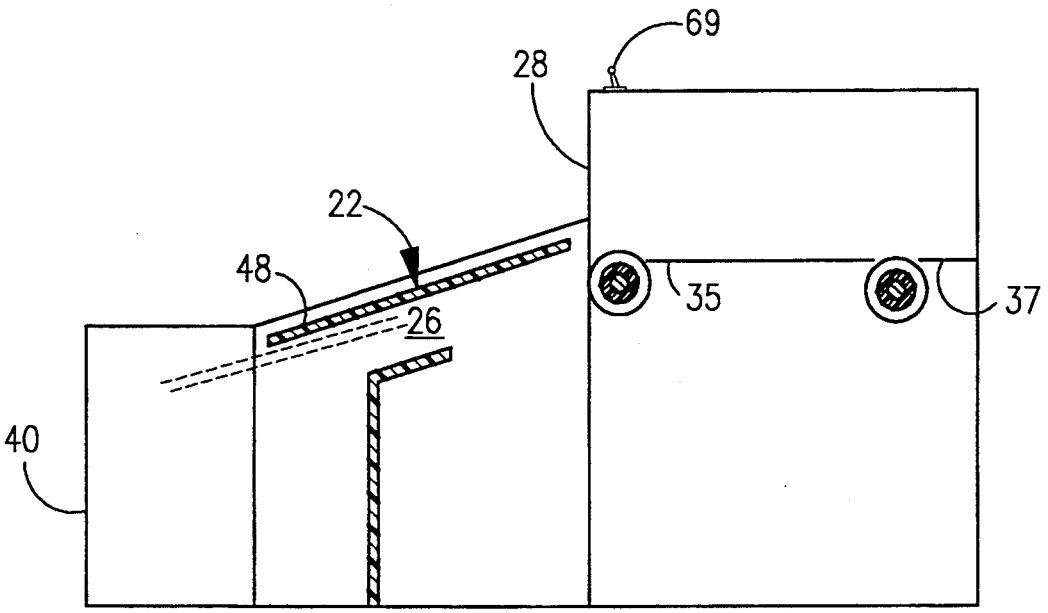

A card shuffler apparatus 10 of the present invention is generally introduced in FIGS. 1–8. As best shown in FIGS. 1 and 2, card shuffler apparatus 10 is adapted to be placed on a horizontal support surface 12 such as a blackjack table or other type of table. For simplicity of illustrating the present invention and where appropriate, each playing card "c" is represented by dashed lines. Accordingly, card shuffler apparatus 10 is operative to combine two stacks 14 of unshuffled playing cards "c" as best shown in FIGS. 3-*a* and 3-*b* into a single stack 16 of shuffled playing cards "c" as best shown in FIGS. 4-*a* and 4-*b*. Card shuffler apparatus 10 includes a card feeder compartment 18, a card receiver compartment 20, a deflector structure 22 and a card ejector mechanism 24. As shown in FIGS. 2, 3-*a* and 3-*b*, card feeder compartment 18 is sized to accommodate the two stacks 14 of unshuffled playing cards "c" in a juxtaposed relationship. With reference to FIGS. 2, 4-*a* and 4-*b*, card receiver compartment 20 is sized to accommodate the single stack 16 of shuffled playing cards "c" and is disposed below card feeder compartment 18. Deflector structure 22 defines a chute 26 which is disposed between and in communication with card feeder compartment 18 and card receiver compartment 20. Card ejector mechanism 24 is associated with card feeder compartment 18 and is operative to simultaneously eject at least a bottom card "c'", as shown in FIG. 3-*b*, in each stack 14 of unshuffled playing cards "c" disposed in card feeder compartment 18 into chute 26. Now, ejected ones of the playing cards "c" deflect into and descend in card receiver compartment 20, as best shown in FIGS. 5-*a*, 5-*b*, 6-*a* and 6-*b*, in order to accumulate in card receiver compartment 20 until all playing cards "c" are ejected from card feeder compartment 18 thereby forming the single stack 16 of shuffled playing cards "c" as shown in FIGS. 4-*a* and 4-*b*.

Figure 10:
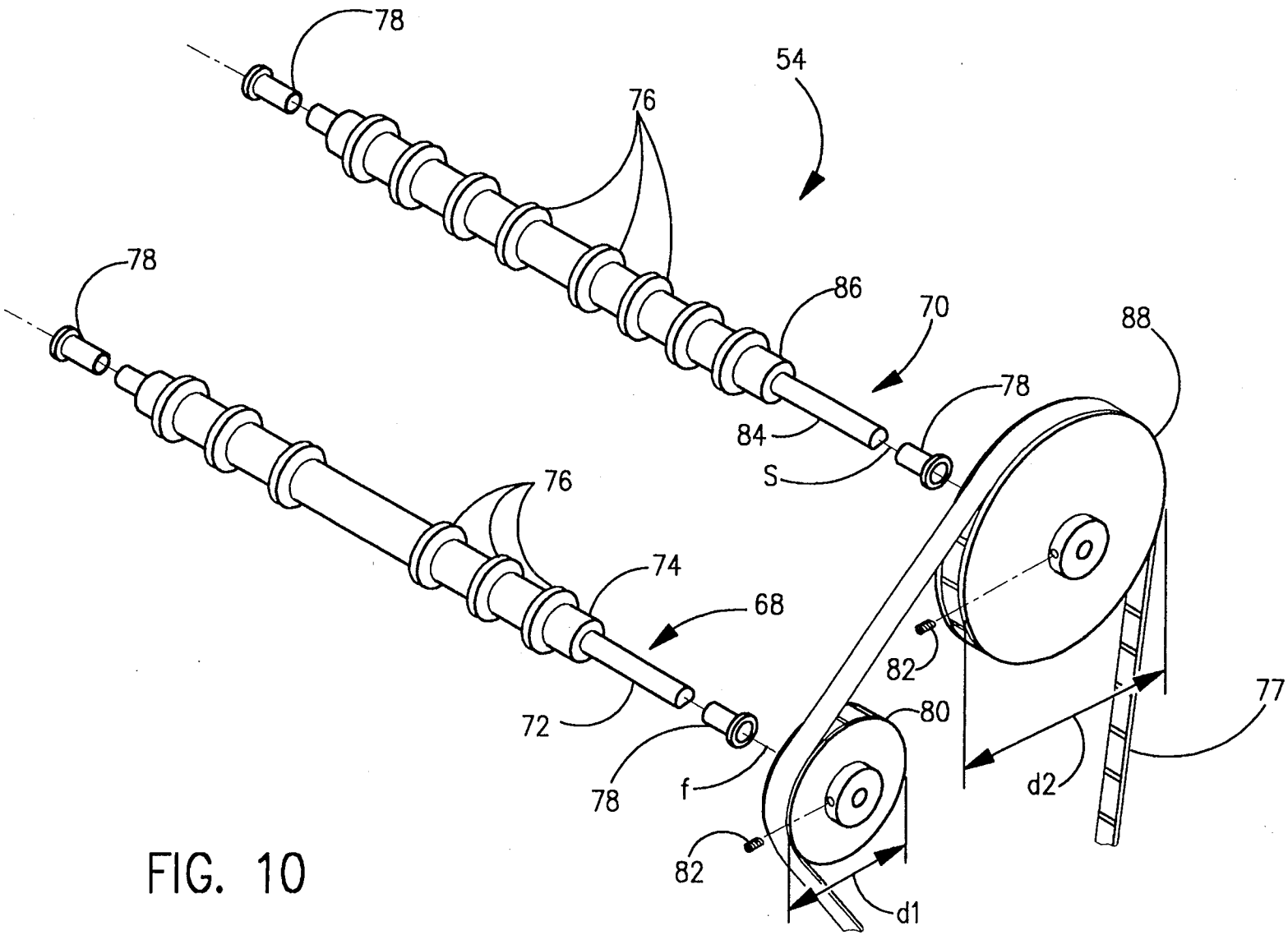
FIG. 10 is a perspective view showing a first and a second roller element of the roller drive assembly.

Card feeder compartment 18 is defined by a vertical fence 28 which is operative to prevent remaining ones in the two stacks 14 of unshuffled playing cards "c" disposed in card feeder compartment 18 from entering chute 26 when card ejector mechanism 24 ejects the bottom cards "c'" in each stack 14 of unshuffled playing cards "c" disposed in feeder compartment 18 into chute 26. Card feeder compartment 18 is also defined by a pair of vertical feeder sidewalls 30 and 32 and a vertical divider 34. The pair of feeder sidewalls 30 and 32 are spaced apart from each other in a parallel relationship and are oriented perpendicularly relative to fence 28. The pair of feeder sidewalls 30 and 32 and fence 28 are connected together. Divider 34 extends perpendicularly relative to fence 28 and is operative to separate the two stacks 14 of unshuffled playing cards "c" from one another. Card feeder compartment 18 is further defined by a first feeder floor panel 35 and a second feeder floor panel 37 which are spaced apart from each other and extend between feeder sidewalls 30 and 32. Divider 34 is connected to fence 28 and to first and second feeder floor panels 35 and 37 as shown in FIG. 10. Note, an indentation "i" is formed between first feeder floor panel 35 and divider 34 proximate to fence 28 which is sized to permit at least a portion of one card "c" to pass therethrough and under fence 28.

Figure 7:
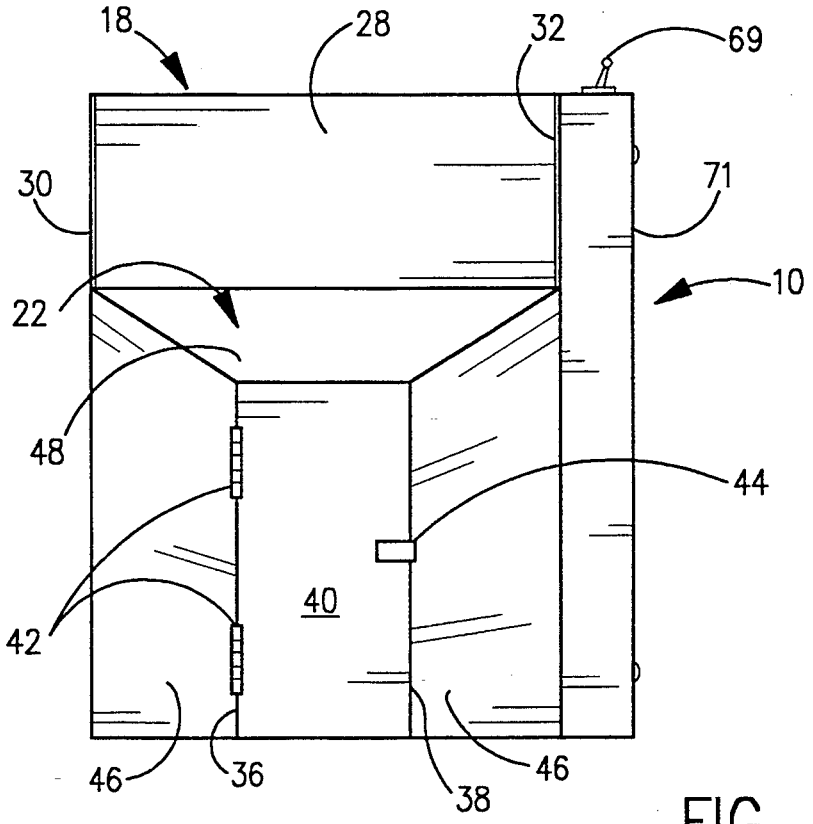
FIG. 7 is a front elevational view of the card shuffler apparatus shown in FIGS. 1 and 2.

Card receiver compartment 20 is defined by a pair of vertical receiver sidewalls 36 and 38 which are spaced apart from and parallel to one another and are oriented parallel to the pair of feeder sidewalls 30 and 32. A card retainer structure 40 extends transversely relative to the pair of receiver sidewalls 36 and 38 and is operative to retain ejected ones of the playing cards within card receiver compartment 20 after card ejector mechanism 24 ejects the bottom cards "c'" in each of the two stacks 14 of unshuffled playing cards "c" disposed in card feeder compartment 20 into chute 26. Although not by way of limitation to the present invention, card retainer structure 40 is a conventional door which is pivotally connected to receiver sidewall 36 by a pair of hinges 42 as best shown in FIGS. 2 and 7. The door is operative to pivot between a closed state (FIG. 7) and an opened state (FIG. 2). In the closed state, the door prevents access into card receiver compartment 20 and, in the opened state, the door allows access into card receiver compartment 20. A mating pair of hook and loop fasteners 44 are connected respectively to the door and receiver sidewall 38 so that the door can be retained in its closed state when desired.

Deflector structure 22 includes a pair of deflector sidewalls 46 and a deflector panel 48. In FIG. 3-*a*, the pair of deflector sidewalls 46 converge from card feeder compartment 18 towards card receiver compartment 20. Specifically, each deflector sidewall 46 converges from a respective one of feeder sidewalls 30 and 32 towards a respective one of receiver sidewalls 36 and 38. Each deflector sidewall 46 forms an angle "a" with fence 28. Although it is preferred that angle "a" is seventy degrees (70°), angle "a" can be any select angle within a range between sixty degrees (60°) and eighty degrees (80°). As best shown in sequence in FIGS. 5-*a* and 6-*a*, deflector sidewalls 46 are operative to deflect ejected ones of the cards "c" into card receiver compartment 20.

Deflector panel 48 extends between deflector sidewalls 46 and is operative to deflect the playing cards "c" ejected into chute 26 from card feeder compartment 18 downwardly into card receiver compartment 20 as best shown in FIG. 5-*b*. With reference to FIG. 3-*b*, deflector panel 48 defines an angle "b" with an imaginary plane "P" which extends parallel with horizontal support surface 12. Although it is preferred that angle "b" is thirty degrees (30°), angle "b" can be selected from a range of twenty degrees (20°) and forty degrees (40°). A bulkhead 50 extends vertically and between deflector sidewalls 46. A deflector floor panel 52 is connected to bulkhead 50 and extends between deflector sidewalls 46.

Figure 8:
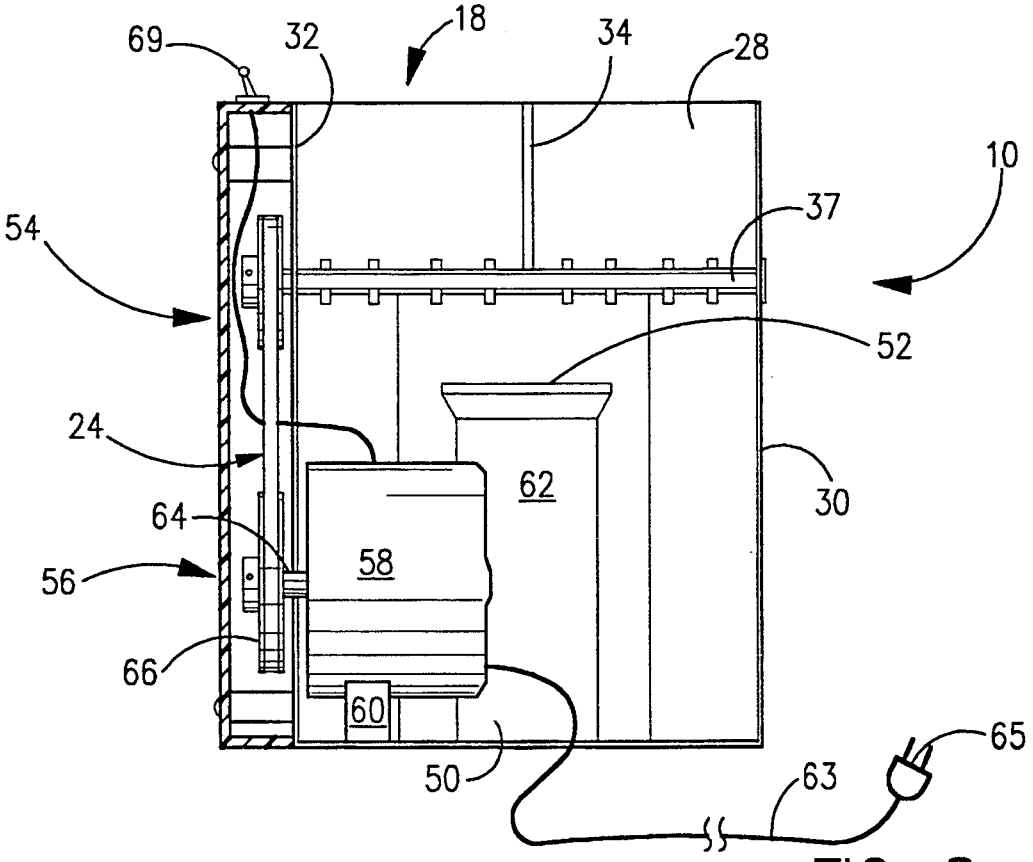
FIG. 8 is a rear elevational view partially in cross-section showing, inter alia, a roller assembly and a roller drive.
Figure 9:
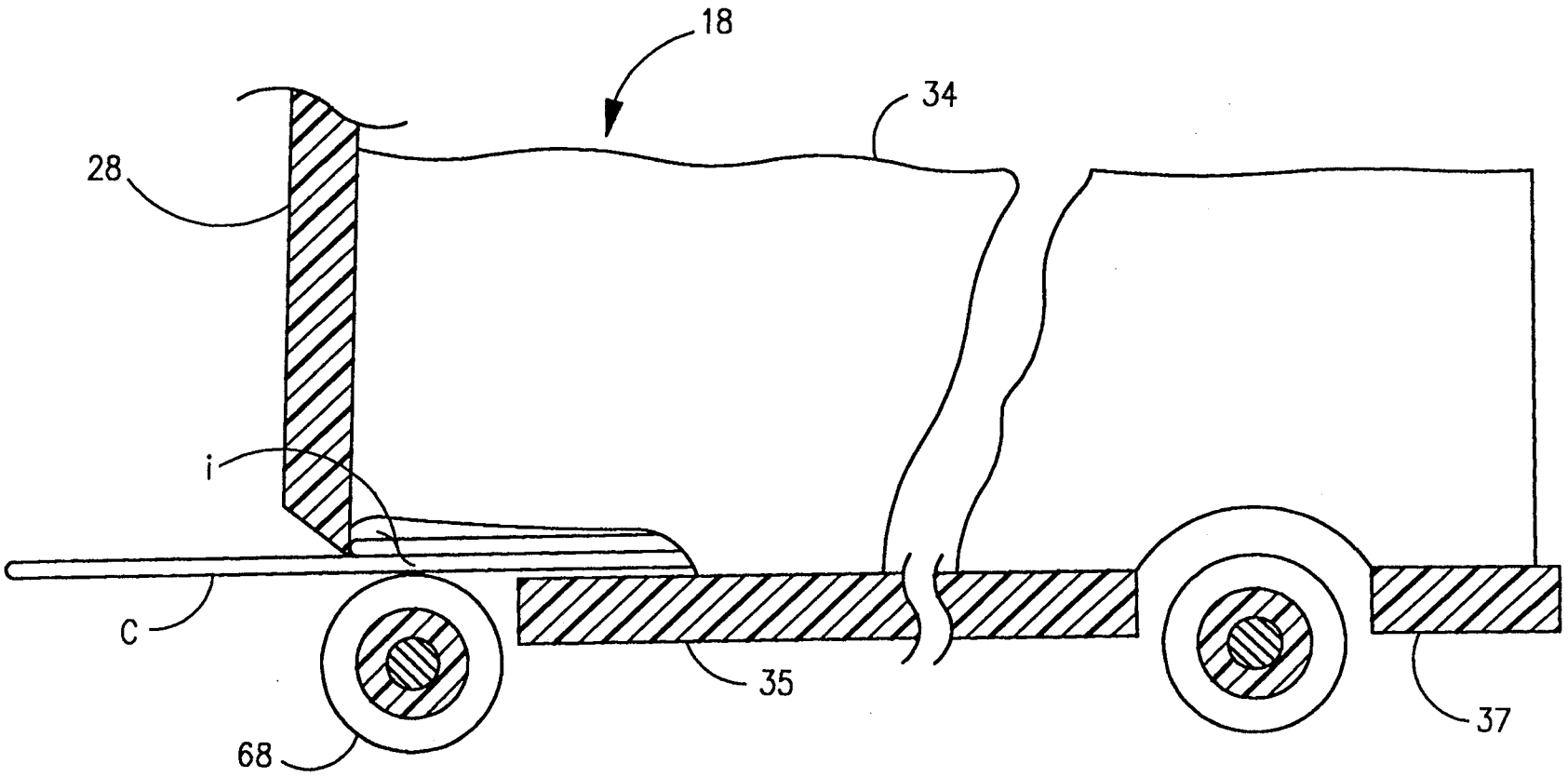
FIG. 9 is an enlarged side elevational view partially in cross-section showing a fence, first and second feeder floor panels and a divider of the card feeder compartment.

Although one of ordinary skill in the art would appreciate that other types of card ejector mechanisms are available for the present invention, only one is described herein as the preferred mechanism. With reference to FIG. 8, card ejector mechanism 24 includes a roller assembly 54 and a roller drive 56 which is operative to impart rotational movement to roller assembly 54. Roller drive 56 includes an electric motor 58 mounted by a mounting element 60 within an interior 62 formed below card feeder compartment 18 and between feeder sidewalls 30 and 32. A conventional cable 63 with a conventional plug 65 plugged into a conventional socket 67 supplies power to electric motor 58. A conventional switch 69 mounted to cover 71 is employed to activate or deactivate electric motor 58. A motor shaft 64 extends through feeder sidewall 32 and connects to roller drive pulley 66. It is preferred that roller drive pulley 66 is a positive traction type.

With reference to FIG. 10, roller assembly 54 includes a first roller element 68 and a second roller element 70. First roller element 68 has a first axis of rotation "f" and second roller element 70 has a second axis of rotation "s". First roller element 68 includes a first roller shaft 72 having a first roller sleeve 74 slidably connected thereto. It is preferred that first roller sleeve 74 is a tube fabricated from a pliable material such as rubber or plastic. A plurality of o-rings 76 preferably fabricated from a rubber material are slidably fitted over first roller sleeve 74. First roller element 68 also includes a pair of bearings 78 fabricated from teflon which receives opposite end portions of first roller shaft 72 and a first roller pulley 80 adapted to connect to an end portion of first roller shaft 72 by a set screw 82.

Second roller element 70 includes a second roller shaft 84 having a second roller sleeve 86 slidably fitted thereon. A plurality of o-rings 76 are slidably mounted onto second roller sleeve 86. Second roller element 70 also includes a pair of bearings 78 which slidably receives opposite end portions of shaft 84 and a second roller pulley 88 which is fastened to an end portion of shaft 84 by set screw 82. Second roller pulley 88 has a larger diameter "d2" than a diameter "d1" of first roller pulley 80 so that roller assembly 54 is operative whereby first roller element 68 rotates more rapidly than second roller element 70. Once all of the pulleys are fastened to respective end portions of the shafts, a continuous belt 77 is fitted around the pulleys to impart rotational movement thereto as best shown in FIG. 2. It is preferred that belt 77 is a positive traction type operative to matably engage with the positive traction type pulleys.

Figure 11:
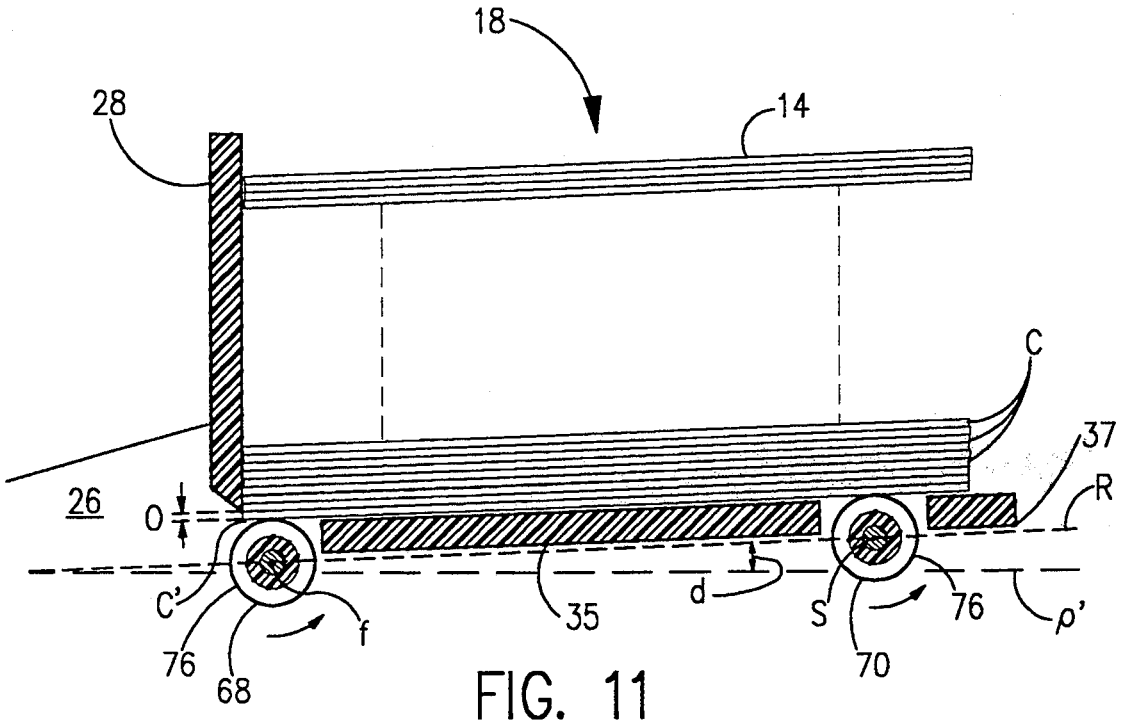
FIG. 11 is a side elevational view in cross-section of the card feeder compartment and the first and second roller elements immediately before a bottom card in a stack of unshuffled cards is ejected into the chute.
Figure 12:
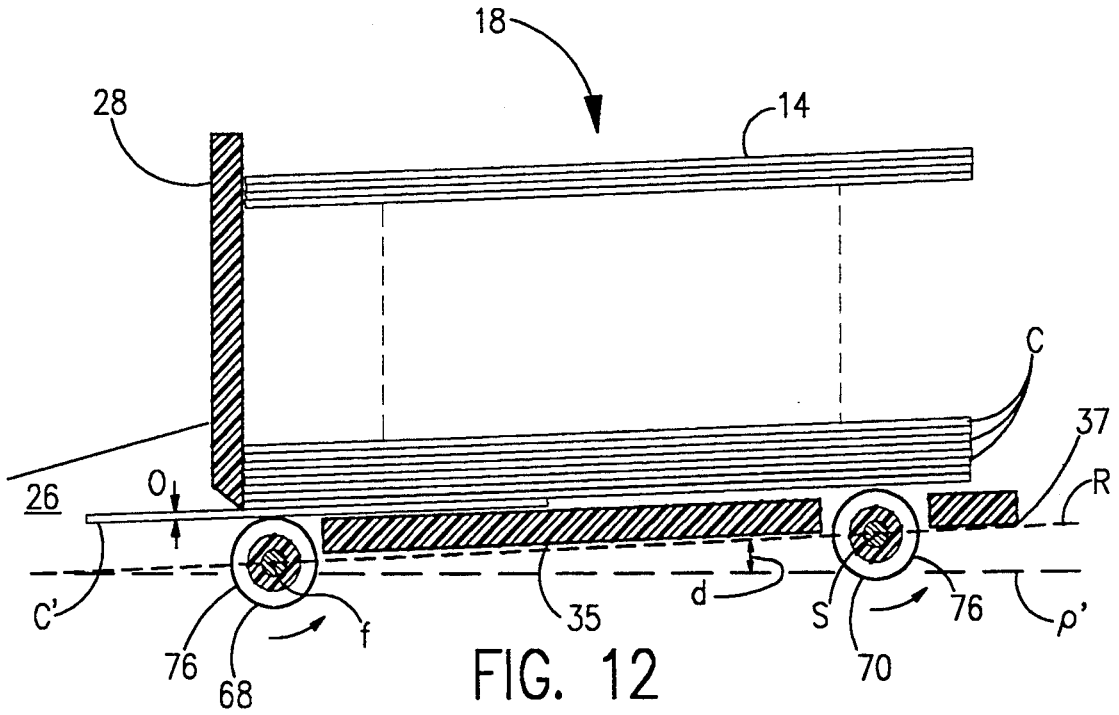
FIG. 12 is a side view in cross-section of the card feeder compartment and the first and second roller elements showing a bottom card being ejected from the card feeder compartment and into the chute.

In FIG. 3-*a*, first roller element 68 is adapted to extend across card feeder compartment 18 and parallel to fence 28. First roller element 68 is disposed proximate to fence 28 to define an opening "o" therebetween as shown by FIGS. 11 and 12. Opening "o" is dimensioned to permit at least single ones in each stack 14 of unshuffled playing cards "c" to pass therethrough when card ejector mechanism 24 ejects the at least bottom card "c'" in each stack 14 of unshuffled playing cards "c" disposed in card feeder compartment 18 into chute 26. Specifically, opening "o" is dimensioned to permit at least the bottom card "c'" in each stack of unshuffled playing cards "c" to pass therethrough. One of ordinary skill in the art would appreciate that it is possible that a plurality of cards "c" including bottom card "c'" could be forced through opening "o" without departing from the spirit of the invention.

With reference again to FIG. 3-*a*, second roller element 70 is spaced apart from first roller element 68 in a parallel relationship and is also adapted to extend across card feeder compartment 18 between and above first and second feeder floor panels 35 and 37. As shown in FIGS. 11 and 12, first axis of rotation "f" of first roller element 68 and second axis of rotation "s" of second roller element 70 define a roller plane "r". Roller plane "r" is oriented relative to an imaginary plane "P'" which extends parallel to horizontal support surface 12 at an angle "d". Although it is preferred that angle "d" is five degrees (5°), angle "d" can be in a range between one degree (1°) and ten degrees (10°). Note that second axis rotation "s" is disposed above the first axis of rotation "f" so that the bottom cards "c'" are ejected from card feeder compartment 18 into chute 26 at a slightly downwardly angle.

As shown in FIGS. 3-*a*, 11 and 12, first roller element 68 and second roller element 70 are operative to support the two stacks 14 of unshuffled playing cards "c" disposed in card feeder compartment 18 by contacting the bottom card "c'" in each stack 14 of unshuffled playing cards "c". As card shuffler apparatus 10 is activated, first roller element 68 and second roller element 70 rotate in a direction shown by arrows "x". Rotating o-rings engage bottom ones "c'" from each stack 14 of unshuffled cards to eject the bottom cards "c'" into chute 26. Note that in FIG. 12, as bottom card "c'" is being ejected from card feeder compartment 18, o-rings 70 rotating on second roller element 70 contact the next card "c" in preparation for its ejection from card feeder compartment 18. Therefore, although not by way of limitation, it is considered that the present invention continuously ejects bottom ones "c'" of the stacks of cards "c" in sequence. In other words, as the bottom ones "c'" of the cards "c" in each stack of unshuffled cards are ejected from the card feeder compartment, the succeeding card then becomes the bottom card. Furthermore, although the card feeder mechanism is operable to simultaneously eject bottom ones of the cards from each stack of unshuffled cards, the cards themselves are not necessarily simultaneously ejected from the feeder compartment. For example, two of the bottom most cards in one stack of unshuffled might stick together momentarily, thus causing asynchronous ejection of cards from each stack. Thus, proper operation of the present invention is insensitive to simultaneous ejection of the cards from each stack.

Figure 13:
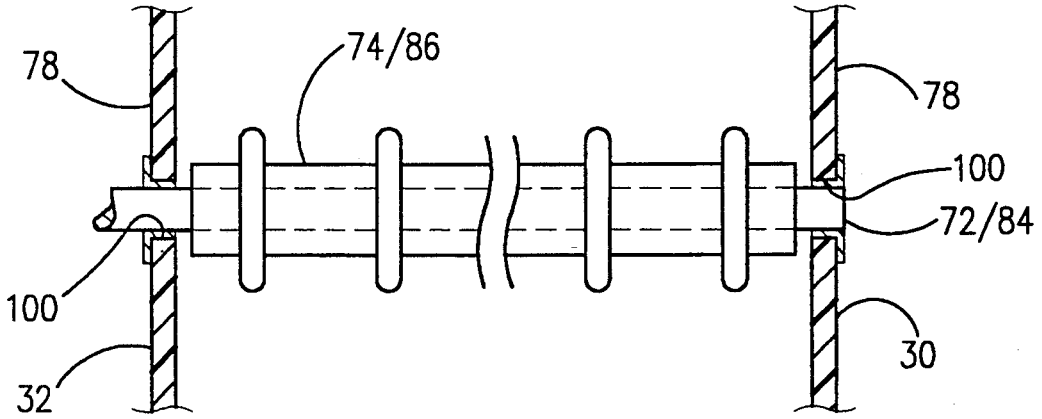
FIG. 13 is an enlarged elevational view of a roller element mounted for rotation into a pair of feeder sidewalls of the card feeder compartment.

FIG. 13 depicts for illustration purposes either first roller element 68 or second roller element 70 mounted for rotation onto and between feeder sidewalls 30 and 32. Bearings 78 are force fitted through respective holes 100 formed into feeder sidewalls 30 and 32. Bearings 78 might also be glued therein with an adhesive. Roller shaft 72 or 84 is received into bearings 78 for rotation. Roller sleeve 74 or 86 is sized so that it can extend between feeder sidewalls 30 and 32 in a manner to prevent roller shaft 72 or 84 from sliding out of bearings 78 during rotation. Thus, when disassembling card shuffler apparatus 10 for maintenance or repair, roller shaft 72 or 84 can simply be slidably removed from roller sleeve 74 or 86 by pulling on the respective pulley. When card shuffler apparatus 10 is fully assembled, cover 71 is placed over the pulleys and belt and is fastened to mounting blocks 75 by screws 73, as shown in FIG. 2.

Figure 14:
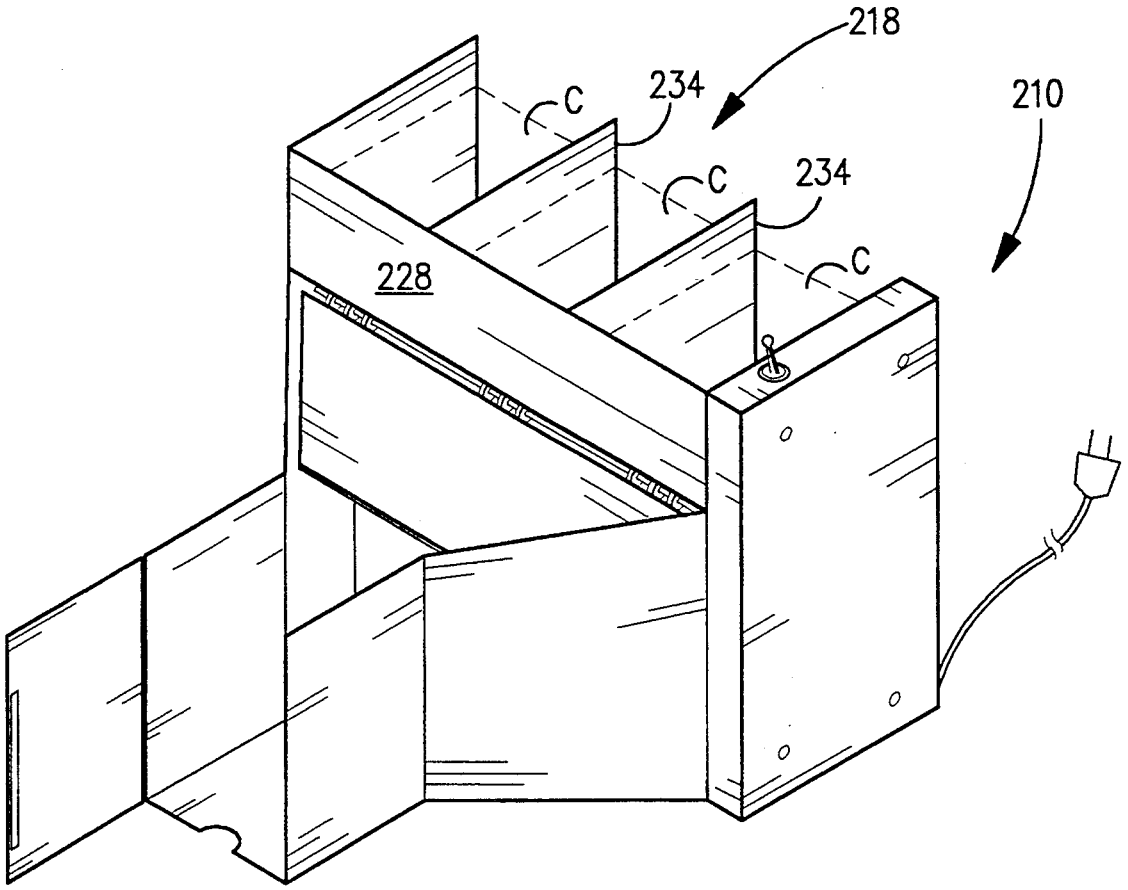
FIG. 14 is a perspective view of a second exemplary embodiment of a card shuffler apparatus of the present invention.

As shown in FIG. 14, a second exemplary embodiment of a card shuffler apparatus 210 of the present invention is shown. Card shuffler apparatus 210 is adapted for use with any type of cards, such as cards used in family board games or trivia games. Card shuffler apparatus 210 is operative to combine a plurality of stacks of unshuffled cards into a single stack of shuffled cards. Each stack of unshuffled cards has at least two cards. A card feeder compartment 218 is sized to accommodate the plurality of stacks of unshuffled cards in a juxtaposed relationship. A card receiver compartment 220 is sized to accommodate the single stack of shuffled cards and disposed below card feeder compartment 218. A deflector structure 222 defines a chute 226 disposed between and in communication with card feeder compartment 218 and card receiver compartment 220. A card ejector mechanism 224 is associated with card feeder compartment 218. Card ejector mechanism 224 is operative to eject at least a single card in each stack of unshuffled cards disposed in card feeder compartment 218 into chute 226 so that ejected ones of the cards deflect into and descend in card receiver compartment 220 to accumulate therein until all cards are ejected from card feeder compartment 218, thereby forming the single stack of shuffled cards. Card feeder compartment 218 includes at least one vertical divider 234 extending perpendicularly relative to a fence 228 and is operative to separate the plurality of stacks of unshuffled cards from one another.

The exemplary embodiments of the card shuffler apparatus of the present invention employs a method for combining a plurality of stacks of unshuffled cards into a single stack of shuffled cards. A first step includes placing the plurality of stacks of unshuffled cards in a card feeder compartment in a juxtaposed relationship. The next step includes ejecting at least a single one of the unshuffled cards from each stack disposed in the card feeder compartment into a chute until all cards are ejected from the card feeder compartment. The next step includes deflecting the at least single ones of the cards ejected into the chute in a card receiver compartment which is disposed below said card feeder compartment and is adapted to accommodate single ones of ejected from the chute to form a single stack of shuffled cards.

One of ordinary skill in the art would appreciate the advantages afforded by the card shuffler apparatus of the present invention. The card shuffler apparatus is mechanically simple and, therefore, its fabrication and maintenance are not problematic. The card shuffler apparatus is also compact so that it may be placed upon a card table without interfering with the game of cards being played. Since the card shuffler apparatus can be placed on a card table, the card players can observe shuffling of the playing cards as a form of entertainment to reduce player boredom during card shuffling if alternating decks of cards are not being employed. The card shuffler apparatus is versatile in that it can shuffle either a single deck of cards or multiple decks of cards. Furthermore, experiments have shown that the card shuffler apparatus of the present invention can shuffler six (6) decks of unshuffled cards in approximately seventeen (17) seconds. A dealer with average skills would require three (3) to five (5) minutes to shuffle six (6) decks of cards. Therefore, the card shuffler apparatus can rapidly shuffle either a single deck of cards or multiple decks of cards.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A card shuffler apparatus adapted to be placed on a horizontal support surface and operative to combine a plurality of stacks of unshuffled cards into a single stack of shuffled cards, each stack of unshuffled cards having at least two cards, comprising:

(a) a card feeder compartment sized to accommodate the plurality of stacks of unshuffled cards in a juxtaposed relationship;

(b) a card receiver compartment sized to accommodate the single stack of shuffled cards and disposed below said card feeder compartment, said card receiver compartment including a pair of vertical receiver sidewalls spaced apart from one another in a parallel relationship and a card retainer structure extending transversely relative to said pair of receiver sidewalls;

(c) a deflector structure defining a chute disposed between and in communication with said card feeder compartment and said card receiver compartment, said deflector structure including a pair of deflector sidewalls converging from said card feeder compartment toward said card receiver compartment; and (d) a card ejector mechanism associated with said card feeder compartment and operative to eject at least a single card in each stack of unshuffled cards disposed in said card feeder compartment into said chute so that ejected ones of the cards deflect into and descend in said card receiver compartment to accumulate therein until all cards are ejected from said card feeder compartment and are retained in said card receiver compartment, thereby forming the single stack of shuffled cards.

2. A card shuffler apparatus according to claim 1 wherein said card feeder compartment is defined by a vertical fence operative to prevent remaining ones in the stacks of unshuffled cards disposed in said card feeder compartment from entering said chute when said card feeder mechanism ejects the at least single card in each stack of unshuffled cards disposed in said card feeder compartment into said chute.

3. A card shuffler apparatus according to claim 2 wherein said card feeder compartment is defined by a pair of vertical feeder sidewalls spaced apart from each other in a parallel relationship and oriented perpendicularly relative to said fence.

4. A card shuffler apparatus according to claim 2 wherein said card feeder compartment includes at least one vertical divider extending perpendicularly relative to said fence and operative to separate the plurality of stacks of unshuffled cards from one another.

5. A card shuffler apparatus according to claim 2 wherein said card feeder mechanism includes a roller assembly having at least a first roller element and a roller drive operative to impart rotational movement to said first roller element.

6. A card shuffler apparatus according to claim 5 wherein said first roller element has a first axis of rotation and is adapted to extend across said card feeder compartment.

7. A card shuffler apparatus according to claim 6 wherein said first roller element extends parallel to said fence and is disposed proximate thereto to define an opening between said fence and said first roller element, said opening dimensioned to permit at least single ones in each stack of the unshuffled cards to pass therethrough when said card feeder mechanism ejects at least single ones in each stack of unshuffled cards disposed in said card feeder compartment into said chute.

8. A card shuffler apparatus according to claim 6 wherein said roller assembly includes a second roller element having a second axis of rotation, said second roller element spaced apart from said first roller element in a parallel relationship and adapted to extend across said card feeder compartment.

9. A card shuffler apparatus according to claim 8 wherein the axis of rotation of said first roller element and the axis of rotation of said second roller element define a roller plane oriented relative to the horizontal support surface within a range of 1 degree and 10 degrees, said second axis of rotation being disposed above said first axis of rotation.

10. A card shuffler apparatus according to claim 9 wherein said first roller element and second roller element are mounted for rotation onto and between said feeder sidewalls and are operative to support the plurality of stacks of unshuffled cards disposed in said card feeder compartment.

11. A card shuffler apparatus according to claim 8 wherein said roller assembly is operative so that said first roller element rotates more rapidly than said second roller element.

12. A card shuffler apparatus according to claim 1 wherein said deflector structure includes a deflector panel extending between said deflector sidewalls and operative to deflect cards ejected into said chute from said card feeder compartment downwardly into said card receiver compartment.

13. A card shuffler apparatus according to claim 11 wherein said retainer structure is a door operative to pivot between a closed state to prevent access into said card receiver compartment and an opened state to allow access into said card receiver compartment.

14. A playing card shuffler apparatus adapted to be placed on a horizontal support surface and operative to combine two stacks of unshuffled playing cards into a single stack of shuffled playing cards, comprising:

(a) a card feeder compartment sized to accommodate the two stacks of unshuffled playing cards in a juxtaposed relationship, said card feeder compartment defined by a pair of vertical feeder sidewalls spaced apart from each other in a parallel relationship;

(b) a card receiver compartment sized to accommodate the single stack of shuffled playing cards and disposed below said card feeder compartment, said card receiver compartment including a pair of vertical receiver sidewalls spaced apart from one another in a parallel relationship and a card retainer structure extending transversely relative to said pair of receiver sidewalls;

(c) a deflector structure defining a chute disposed between and in communication with said card feeder compartment and said card receiver compartment, said deflector structure including a pair of deflector sidewalls, each deflector sidewall converging from a respective one of said feeder sidewalls toward a respective one of said receiver sidewalls; and (d) a card ejector mechanism associated with said card feeder compartment and operative to simultaneously eject at least a bottom card in each stack of unshuffled playing cards disposed in said card feeder compartment into said chute so that ejected ones of the playing cards deflect into and descend in said card receiver compartment to accumulate therein until all playing cards are ejected from said feeder compartment and are retained in said card receiver compartment, thereby forming the single stack of shuffled playing cards.

15. A playing card shuffler apparatus according to claim 14 wherein said card feeder compartment is defined by a vertical fence operative to prevent remaining ones in the two stacks of unshuffled playing cards disposed in said card feeder compartment from entering said chute when said card feeder mechanism ejects the at least bottom cards in each stack of unshuffled playing cards disposed in said card feeder compartment into said chute.

16. A playing card shuffler apparatus according to claim 15 wherein said card feeder compartment includes a vertical divider extending perpendicularly relative to said fence and operative to separate the two stacks of unshuffled playing cards from one another.

17. A playing card shuffler apparatus according to claim 16 wherein said deflector structure includes a deflector panel extending between said deflector sidewalls and operative to deflect playing cards ejected into said chute from said card feeder compartment downwardly into said card receiver compartment.

18. A playing card shuffler apparatus according to claim 16 wherein said card feeder mechanism includes a roller assembly having at least a first roller element with a first axis of rotation and a roller drive operative to impart rotational movement to said first roller element, said first roller element adapted to extend across said card feeder compartment parallel to said fence and disposed proximate thereto to define an opening between said fence and said first roller element, said opening dimensioned to permit at least bottom ones in each stack of the unshuffled playing cards to pass therethrough when said card feeder mechanism ejects at least bottom ones in each stack of unshuffled playing cards disposed in said card feeder compartment into said chute.

19. A playing card shuffler apparatus according to claim 18 wherein said roller assembly includes a second roller element having a second axis of rotation, said second roller element spaced apart from said first roller element in a parallel relationship and adapted to extend across said card feeder compartment so that the axis of rotation of said first roller element and the axis of rotation of said second roller element define a roller plane oriented relative to the horizontal support surface within a range of 1 degree and 10 degrees, said second axis of rotation being disposed above said first axis of rotation.

20. A playing card shuffler apparatus according to claim 19 wherein said first roller element and second roller element are mounted for rotation onto and between said feeder sidewalls and are operative to support the two stacks of unshuffled playing cards disposed in said card feeder compartment by contacting the bottom card in each stack of unshuffled playing cards.

21. A playing card shuffler apparatus according to claim 20 wherein said roller element assembly is operative so that said first roller element rotates more rapidly than said second roller element.

22. A playing card shuffler apparatus according to claim 14 wherein said retainer structure is a door operative to pivot between a closed state to prevent access into said card receiver compartment and an opened state to allow access into said card receiver compartment.

* * * * *